US005524409A

United States Patent [19]

Kaiser

[11] Patent Number: 5,524,409

[45] Date of Patent: Jun. 11, 1996

[54] ROOFING AND SIDING PANEL CONSTRUCTION

[76] Inventor: Heinz W. Kaiser, 90130 Prairie Rd., Eugene, Oreg. 97402

[21] Appl. No.: 348,346

[22] Filed: Dec. 2, 1994

[51] Int. Cl.[6] ..... E04C 1/10

[52] U.S. Cl. ..... 52/588.1; 52/537

[58] Field of Search ..... 52/588.1, 537

[56] References Cited

U.S. PATENT DOCUMENTS

| | | | |
|---|---|---|---|
| 3,606,720 | 9/1971 | Cookson | 52/714 |
| 4,091,588 | 5/1978 | Heirich | 52/588.1 X |
| 4,109,437 | 8/1978 | Player et al. | 52/588.1 X |
| 4,192,117 | 3/1980 | Heirich | 52/588.1 X |
| 4,223,503 | 9/1980 | Hague | 52/588.1 X |
| 4,266,385 | 5/1981 | Oehlert | 52/588.1 X |
| 4,285,182 | 8/1981 | Dinges | 52/478 |
| 4,400,922 | 8/1983 | Boyer | 52/394 |
| 4,406,106 | 9/1983 | Dinges | 52/478 |
| 4,466,224 | 8/1984 | Hague | 52/478 |
| 4,467,582 | 8/1984 | Hague | 52/478 |
| 4,486,998 | 12/1984 | Hague | 52/478 |
| 4,759,159 | 7/1988 | Blazley | 52/588.1 X |
| 4,918,898 | 4/1990 | McLeod | 52/588.1 |
| 5,201,158 | 4/1993 | Bayley et al. | 52/537 |

*Primary Examiner*—Carl D. Friedman
*Assistant Examiner*—Beth A. Aubrey
*Attorney, Agent, or Firm*—James D. Givnan, Jr.

[57] ABSTRACT

A building roof or wall covering consisting of panels formed along their lengthwise edge with each panel having a central expanse which may include a rib. Each panel has a primary rib edge structure including a foot for securement to an underlying building component and additionally including a first wall extending upwardly from the foot and having outwardly and inwardly inclined portions which terminate in a rib top wall. Acutely convergent wall portions of a remaining wall form a lip having an apex. A secondary rib edge structure includes a marginal edge also of acute cross section for hooked engagement with the apex of the primary rib on an adjacent panel and also having an outer wall overlying the top wall of the primary rib of the adjacent panel. Outwardly and inwardly inclined panel portions of the secondary rib overlie and engage in a retentive manner the outwardly and inclined wall portions of the primary rib of an adjacent panel.

6 Claims, 2 Drawing Sheets

ROOFING AND SIDING PANEL CONSTRUCTION

BACKGROUND OF THE INVENTION

The present invention pertains generally to elongate panels joined at their sides to provide the exterior of building walls and roof structures.

Well known in the building construction is the use of sheet metal panels shaped along their marginal edges for interlocking engagement to provide a joint between panels. A wide variety of panel edge configurations are disclosed in the prior art. Such configurations are typically formed in a continuous manner on roll forming machines.

Panel securement to roof or wall members of a building entails the prior installation of clips on roof members with the clips shaped to engage edge or rib surfaces for panel retention. A problem encountered with the use of clips results from the accuracy necessary in clip installation. For example, U.S. Pat. No. 4,285,182 is directed toward locator strips for clip spacing, while U.S. Pat. Nos. 4,400,922 and 4,486,998 disclose a clip directed toward compensating for "rib-to-clip and joint-to-clip misalignments" and a clip to overcome rib spacing problems.

U.S. Pat. No. 4,406,106 discloses a clip, a pair of laterally projecting "tongues" to which panel ribs, of corresponding shape, are flexibly engaged.

U.S. Pat. Nos. 4,466,224 and 4,467,582 disclose clips for panel securement with the clips having "wings" which flex inwardly during panel attachment and thereafter flex outwardly to seat against the base of a panel rib. U.S. Pat. No. 3,606,720 discloses a clip for securing a centrally disposed panel rib. This patent disclosure is of interest in that it discloses the marginal edge configurations of a panel which are shaped to provide cooperating inclined surfaces to effect "camming" during downward pressure being exerted on the outer panel edge during formation of a joint between adjacent panels.

In addition to serving to attach a panel to a roof or wall member clips serve to reinforce panel ribs against externally applied loads but only at widely spaced intervals leaving the rib segment between clips susceptible to damage as, for example, by being stepped on. In addition to the above noted negative aspects of utilizing clips at precisely spaced intervals for panel to roof securement, such clips are typically of costly manufacture.

While some prior art roof panels have dispensed with the necessity of clips, such panels require that a continuous roof or wall underlayment be in place prior to panel installation on same. The cost and installation of such an underlayment is a significant factor in the overall cost of such a roof.

Existing panel designs rely on interengageable ribs formed along the sides of adjacent panels to form a joint. Such engaged ribs form a joint which is susceptible to damage as when an installer or worker inadvertently steps on such a joint. Such panel designs rely on clips on 4 and 6 foot centers with the span of the joint between clips being susceptible to damage as noted above.

SUMMARY OF THE PRESENT INVENTION

The present invention is embodied in a roof or wall panel wherein novel rib structure permits dispensing with clips for panel attachment to a roof member without jeopardizing panel attachment or strength.

A primary rib structure along a panel edge includes a top wall outwardly offset from and in parallel with a building wall or a roof component. A secondary rib component includes an outer wall which overlies the top wall held in place by inwardly and outwardly inclined portions of the assembled panels. The panels, being formed of sheet material, may rotate and flex somewhat during hooked engagement of cooperating rib components. A groove in a rib top wall ensures prevention of moisture reaching underlying roof components. A foot along the remaining edge of each panel serves to receive fastener elements. Such fasteners are not subjected to the weather nor are they visible in a completed roof. The continuous foot permits panel securement to a roof component at more frequent intervals for greater resistance to uplift. Further, the present panel is less susceptible to damage from momentary loads as from a worker stepping on the rib joint.

DETAILED DESCRIPTION OF THE PREFERRED EMBODIMENTS

Figure 1:
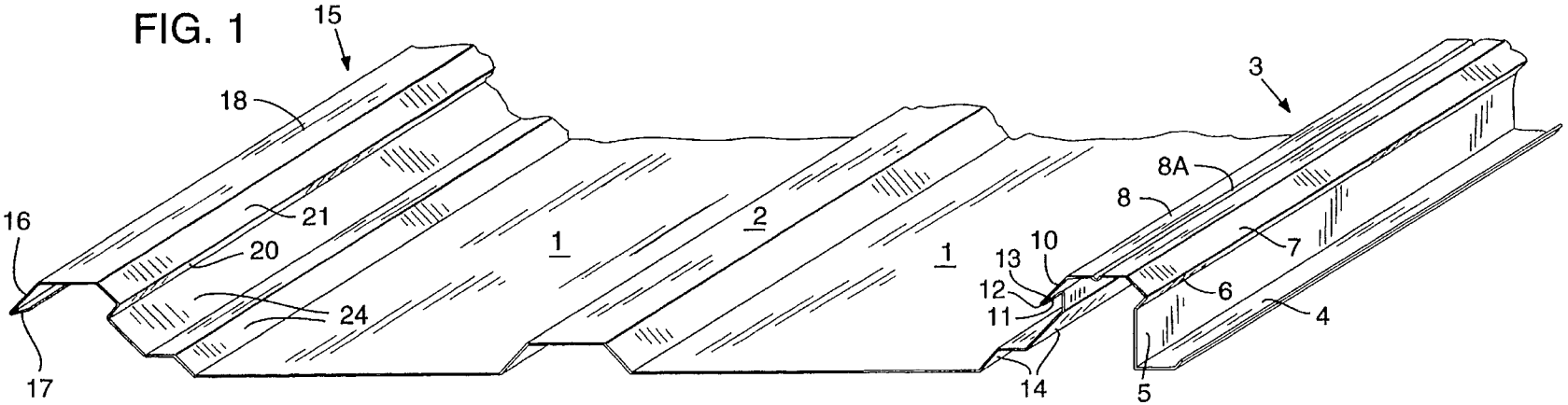
FIG. 1 is a perspective view of a panel segment embodying the present invention.
Figure 2:
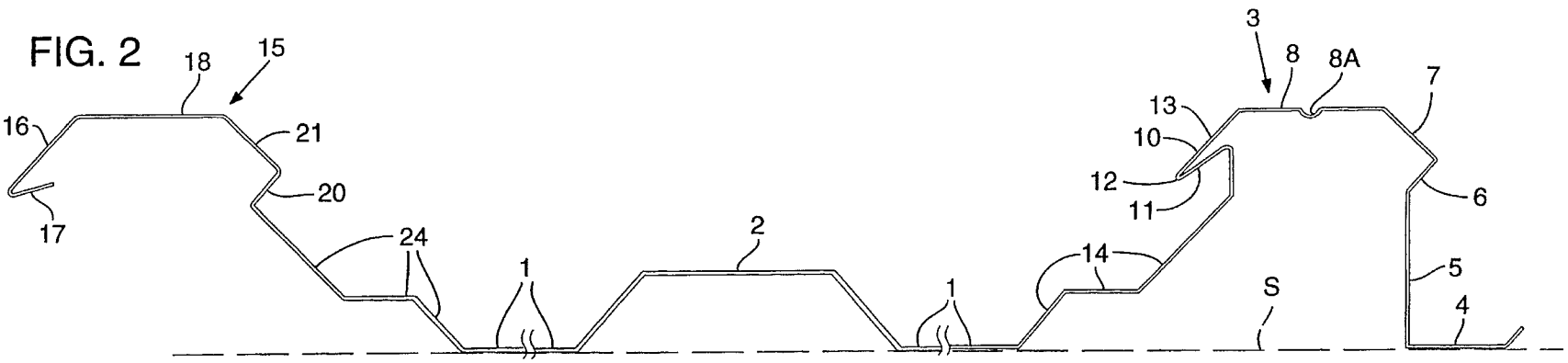
FIG. 2 is an end elevational view of FIG. 1.
Figure 3:
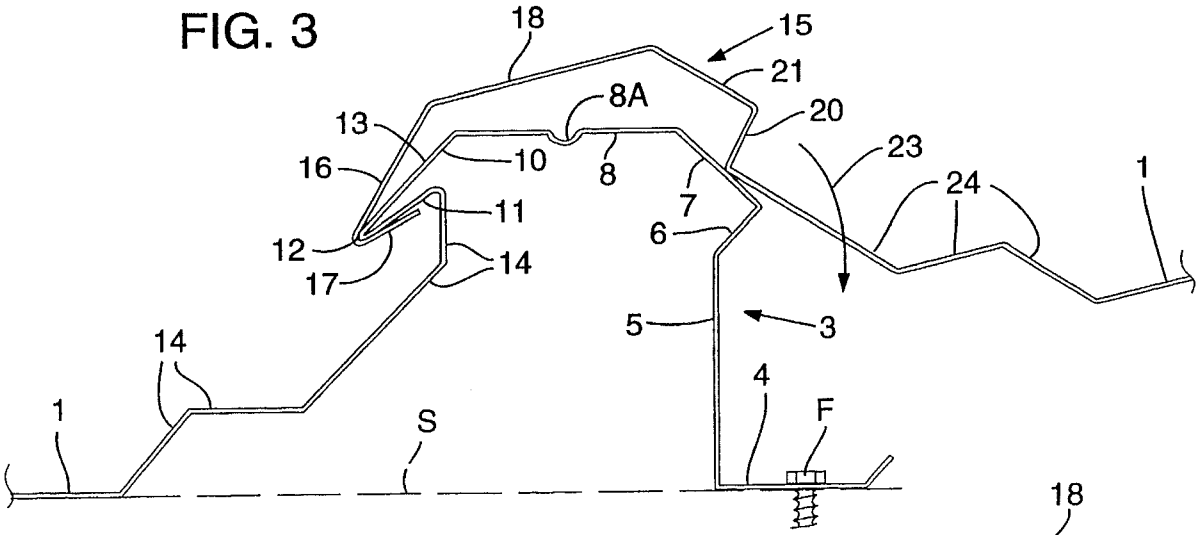
FIG. 3 is a fragmentary end elevational view of adjacent panels during assembly of a panel joint.
Figure 4:
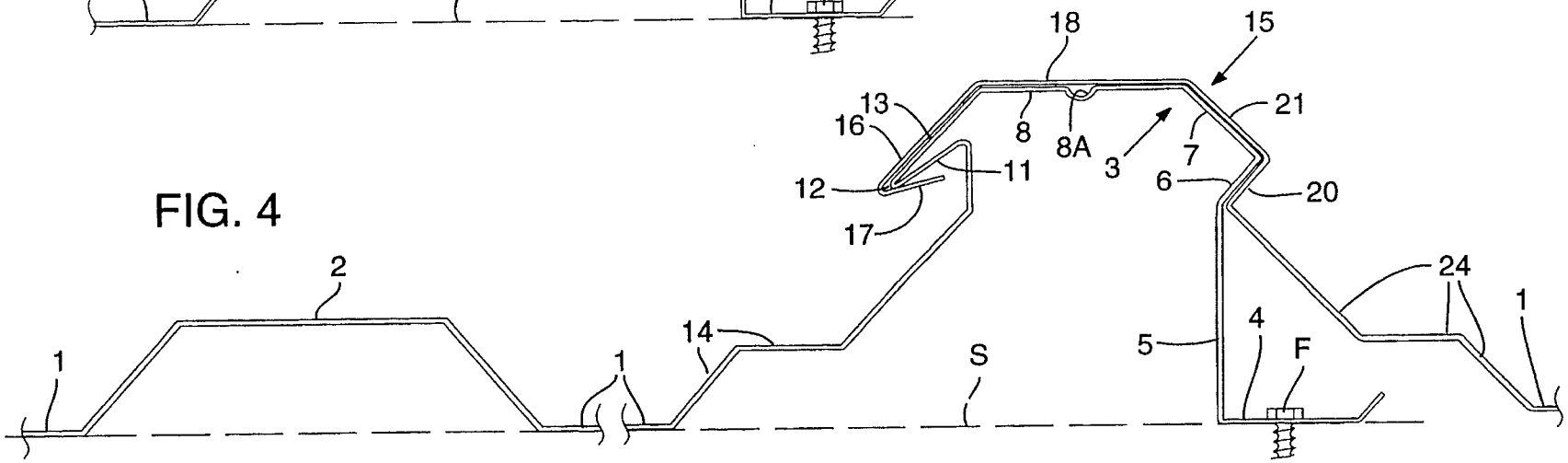
FIG. 4 is a view similar to FIG. 3 but with the joint completed.

With continuing attention to the drawings wherein applied reference numerals indicate parts similarly hereinafter identified, the reference numeral 1 indicates a central expanse of a roof or wall panel which preferably includes a central rib 2 to avoid oil canning of the central expanse of the panel.

A primary rib is indicated generally at 3 in place along one lengthwise extending edge of the panel. Said primary rib includes a foot 4 integral with a first wall 5 which includes outwardly and inwardly inclined wall portions 6 and 7.

A top wall 8 of the primary rib is offset from a roof or wall surface S of a building structure. A groove 8A along the top wall constitutes a barrier for moisture to prevent same from migrating intermediate overlying rib surfaces. Said top wall is integral with acutely convergent wall portions 10 and 11 which form an inwardly directed lip 13 defining an included angle of less than 30° with an apex at 12. Lowermost convergent wall portion 11 is integral with a second wall 14 of the primary rib which also extends in an inclined manner into mergence with central expanse 1 of the panel.

A secondary rib is indicated generally at 15 and extends along the remaining lengthwise side of the present panel and is adapted for engagement with primary rib 3. Marginal edges 16 and 17 of secondary rib 15 provide a marginal edge structure for hooked engagement with lip 13. The acute included angle defined by marginal edges 16 and 17 is, at least initially, of somewhat greater magnitude than that defined by wall portions 10 and 11 to facilitate hooked engagement of marginal edges 16 and 17 with the lip of the primary rib and permitting subsequent rotational movement of secondary rib 15 about apex 12 of the primary rib. An outer wall 18 of secondary rib 15 overlies top wall 8 of the primary rib. Outwardly and inwardly inclined panel portions 20 and 21 of the secondary rib are intended to fit in a snug manner over inclined wall portions 6 and 7. As the present panel is contructed from sheet material including metal or plastic and is of a gauge permitting flexing during panel installation, the inclined panel portions 20 and 21, as well as outer wall 18, may flex to complete overlying placement, per arrow 23, of the second rib on the primary rib. An inclined wall 24 of the secondary rib contributes strength to the rib joint and secondly provides clearance for a fastener F extending through foot 4 and into a roof or wall component.

Marginal edge member 17 may be upwardly closed into abutment with lip 13 with a clamping tool or a seam former which acts on edge member 17 in a progressive manner.

The surface at S may be that of a purlin spaced on 4 or 6 foot centers with fastener F being a self tapping screw. A downward force on secondary rib 15, subsequent to hooked engagement of same with lip 13, may be by foot applied pressure as the rib structure formed by the first and secondary ribs 3 and 15 is not susceptible to damage from such loading.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A panel of sheet material for installation on a building roof or wall member in side by side engaged fashion with adjacent panels of sheet material, said panel comprising, a central expanse for support by a roof or wall member, a primary rib edge structure including a foot terminating at a free edge of said panel for overlying placement and securement to said roof or wall member, a first wall integral with said foot and terminating upwardly in contiguous outwardly and inwardly inclined wall portions, a top wall offset from said foot, acutely convergent wall portions integral with said top wall and having an apex, and a second wall integral with one of said convergent wall portions and with said central expanse, and a secondary rib edge structure including a marginal edge of acute cross section for hooked engagement with said apex of one of said adjacent panels, an outer wall for overlying placement on said top wall of the primary rib edge structure of an adjacent panel, outwardly and inwardly inclined rib portions for overlying surfacial engagement with the outwardly and inwardly inclined wall portions of said primary rib edge structure of an adjacent panel and an inclined wall extending intermediate said inclined rib portions and said central expanse of the panel.

2. The panel claimed in claim 1 wherein said acutely convergent wall portions of said primary rib define an included angle of less than forty-five degrees.

3. The panel claimed in claim 2 wherein said marginal edge member of said secondary rib define an acute included angle of greater angularity than said acutely convergent wall portions and permit rotation of said secondary rib subsequent to engagement with the primary rib.

4. A panel of sheet material for installation on a roof or wall members of a building, said panel including, a primary rib including upright wall members, one of said wall members terminating in a lip embodied in convergent wall portions defining an acute included angle, another of said wall members terminating in intersecting inclined wall portions, and a top wall extending intermediate said wall members, and a secondary rib including a marginal edge of acute cross section for hooked engagement with said lip, an outer wall for surfacial engagement with said top wall, and outwardly and inwardly inclined rib portions for overlying engagement with said intersecting inclined wall portions of the primary rib structure, the outer wall intermediate the rib portions and the marginal edge.

5. The panel claimed in claim 4 wherein said convergent wall portions define an included angle of less than forty-five degrees.

6. The panel claimed in claim 5 wherein said marginal edge member of said secondary rib define an acute included angle of greater angularity than said acutely convergent wall portions and permit rotation of said secondary rib subsequent to engagement with the primary rib.

* * * * *